US011694642B2

(12) United States Patent
Chen

(10) Patent No.: US 11,694,642 B2
(45) Date of Patent: Jul. 4, 2023

(54) METHOD FOR DRIVING MINI-LED BACKLIGHT MODULE

(71) Applicant: TCL CHINA STAR OPTOELECTRONICS TECHNOLOGY CO., LTD, Guangdong (CN)

(72) Inventor: Xiaolong Chen, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 322 days.

(21) Appl. No.: 17/054,739

(22) PCT Filed: Oct. 23, 2020

(86) PCT No.: PCT/CN2020/123161

§ 371 (c)(1),
(2) Date: Nov. 11, 2020

(87) PCT Pub. No.: WO2022/047922

PCT Pub. Date: Mar. 10, 2022

(65) Prior Publication Data

US 2022/0319441 A1 Oct. 6, 2022

(30) Foreign Application Priority Data

Sep. 2, 2020 (CN) ..... 202010909073.8

(51) Int. Cl.

| | |
|---|---|
| ***G09G 3/3233*** | (2016.01) |
| ***G09G 3/34*** | (2006.01) |
| ***G09G 3/20*** | (2006.01) |

(52) U.S. Cl.

CPC ..... *G09G 3/342* (2013.01); *G09G 3/2007* (2013.01); *G09G 2320/0233* (2013.01); *G09G 2320/0626* (2013.01)

(58) Field of Classification Search

CPC ..... G09G 3/342; G09G 3/2007; G09G 2320/0233; G09G 2320/0626; G09G 3/3233

See application file for complete search history.

(56) References Cited

U.S. PATENT DOCUMENTS

| | | | | |
|---|---|---|---|---|
| 6,151,000 | A | 11/2000 | Ohtaka et al. | |
| 2020/0005710 | A1* | 1/2020 | Miyata | G09G 3/3233 |

FOREIGN PATENT DOCUMENTS

| | | | |
|---|---|---|---|
| CN | 102667903 | A | 9/2012 |
| CN | 104749847 | A | 7/2015 |
| CN | 108053800 | A | 5/2018 |
| CN | 109559672 | A | 4/2019 |
| CN | 109920363 | A | 6/2019 |
| EP | 1365382 | A1 | 11/2003 |

* cited by examiner

*Primary Examiner* — Abdul-Samad A Adediran

(57) ABSTRACT

The present application provides a method for driving a mini-LED backlight module. The method includes dividing the mini-LED backlight module into a plurality of partitions along an extending direction of a data line, dividing a period of each frame used in the mini-LED backlight module into an adjusting sub-field, and adjusting durations of a bright sub-field or a dark sub-field of the adjusting sub-field corresponding to different partitions based on different gray modes. In such a way, the brightness of each partition falls within a configured brightness threshold range.

18 Claims, 3 Drawing Sheets

METHOD FOR DRIVING MINI-LED BACKLIGHT MODULE

FIELD OF THE DISCLOSURE

The present application relates to display technologies, and more particularly to a method for driving a mini-LED backlight module.

DESCRIPTION OF RELATED ARTS

With the development of display technologies, flat-panel displays have been widely used in information display products and have broad market prospects due to their advantages of high resolution, vivid image color, power saving, lightweight and portability. However, as the increasing maturity of driving technologies in the field of display panels, opportunities and challenges follow. Due to restrictions on backlight of liquid crystal displays (LCDs), such as high-power consumption and low contrast, backlight technologies are forced to move toward local dimming. The mini LED backlight modules with the local dimming technology can yield better contrast and high-dynamic range (HDR).

Traditional mini-LED backlight technologies adopt static driving or passive-matrix (PM) driving scheme to realize the local dimming. Since each partition needs to be controlled by using a single or separate data line, this makes the number of partitions generally less than 2000 and makes the required number of driving integrated circuits (ICs) be too much, resulting in relatively high product costs.

Technical Problems

Currently, mini-LED backlight driving methods based on active matrix (AM) type have become an efficient solution to reduce the number of LED driving chips to realize cost reduction; however, with the development of surface mounted technology (SMT) and the needs to reduce the cost of mini-LED backlight, a single backlight plate is getting bigger and bigger, resulting in inconsistent RC loading for proximal and distal ends of the data line. Specifically, RC loading at the proximal end of the data line is relatively small, and RC loading at the distal end of the data line is relatively large. In addition, an IR drop effect exists. All these factors cause the brightness difference between mini-LEDs of the mini-LED backlight plate at the proximal and distal ends of the data line. In the mini-LED backlight plate, the part close to the proximal end of the data line is relatively bright, and the part close to the distal end of the data line is relatively dark. Accordingly, it causes uneven brightness of the mini-LED backlight plate and seriously affects backlight quality.

Technical Solutions

Embodiments of the present application provide a method for driving an mini-LED backlight module, for solving the technical problems of the existing mini-LED backlight modules, in which the brightness of a mini-LED backlight plate is uneven, caused by inconsistent RC loading for proximal and distal ends of data line.

To solve above problems, the technical solutions provided in the present application are described below.

The present application provides a method for driving a mini light emitting diode (mini-LED) backlight module, including steps of:

Step S100: dividing the mini-LED backlight module into M partitions along a first direction, wherein the mini-LED backlight module includes a control unit and a data line connected to the control unit, the first direction is a direction extending from an end of the data line close to the control unit to an end of the data line away from the control unit, and the M partitions include a first partition, a second partition, . . . , a (M−1)-th partition and a M-th partition that are arranged sequentially along the first direction;

Step S200: dividing a period of each frame used in the mini-LED backlight module into an adjusting sub-field and N displaying sub-fields for driving the mini-LED backlight module to emit light, wherein in a time duration of the adjusting sub-field, the data line outputs a low voltage level to a part of the mini-LED backlight module located in the first partition and the data line outputs a high voltage level to a part of the mini-LED backlight module located in the M-th partition; and adjusting the time duration of the adjusting sub-field based on brightness values of the first partition and the M-th partition, to obtain a duration $T_{adjust}$ of the adjusting sub-field that makes a brightness difference between the first partition and the M-th partition fall within a first brightness threshold range;

Step S300: dividing the adjusting sub-field corresponding to each partition into a bright sub-field and a dark sub-field, wherein in the duration of the bright sub-field corresponding to any of the partitions, the data line outputs the high voltage level to a part of the mini-LED backlight module located in the partition; in the duration of the dark sub-field corresponding to any of the partitions, the data line outputs the low voltage level to a part of the mini-LED backlight module located in the partition; and driving the mini-LED backlight module to emit light in different gray modes, and in each of the gray modes, adjusting the time duration of the bright sub-field or the dark sub-field corresponding to each partition based on the brightness value of each partition, to obtain under the gray mode the duration of the bright sub-field and the duration of the dark sub-field that make the brightness difference between each partition and the first partition fall within a second brightness threshold range; and Step S400: driving the mini-LED backlight module to emit light based on the duration of the bright sub-field and the duration of the dark sub-field corresponding to each partition under different gray modes.

In the method for driving the mini-LED backlight module provided in the present application, in Step 200, the adjusting the time duration of the adjusting sub-field based on brightness values of the first partition and the M-th partition, to obtain a duration $T_{adjust}$ of the adjusting sub-field that makes a brightness difference between the first partition and the M-th partition fall within a first brightness threshold range, includes:

increasing the time duration of the adjusting sub-field when the brightness difference between the first partition and the M-th partition exceeds the first brightness threshold range and the brightness value of the first partition is greater than the brightness value of the M-th partition; or decreasing the time duration of the adjusting sub-field when the brightness difference between the first partition and the M-th partition exceeds the first brightness threshold range and the brightness value of the first partition is less than the brightness value of the M-th partition; driving the mini-LED backlight module to emit light, wherein in the increased or decreased time duration of the adjusting sub-field, the data line outputs the low voltage level to a part of the mini-LED backlight module located in the first partition and the data line outputs the high voltage level to a part of the mini-LED backlight module located in the M-th partition; or obtaining the duration $T_{adjust}$ of the adjusting sub-field once the driving of the mini-LED backlight module makes the brightness difference between the first partition and the M-th partition fall within the first brightness threshold range.

In the method for driving the mini-LED backlight module provided in the present application, in Step S200, before each time the mini-LED backlight module is driven to emit light, the method includes calculating the duration of each displaying sub-field based on the following formulas:

$$T_1=(1/f-T_{adjust})/(2^N-1); \text{ and}$$

$$T_n=2^{n-1}T_1,$$

where $T_1$ is the duration of a first displaying sub-field, $T_n$ is the duration of an n-th displaying sub-field, $2 \le n \le N$, and f is a display frequency of the mini-LED backlight module.

In the method for driving the mini-LED backlight module provided in the present application, when the brightness difference between the first partition and the M-th partition exceeds the first brightness threshold range and the brightness value of the first partition is greater than the brightness value of the M-th partition, the time duration of the adjusting sub-field increases and an amount of time increased for each time is $T_{increase}$; and when the brightness difference between the first partition and the M-th partition exceeds the first brightness threshold range and the brightness value of the first partition is less than the brightness value of the M-th partition, the time duration of the adjusting sub-field decreases and an amount of time decreased for each time is $T_{decrease}$, wherein $T_{increase}=T_{decrease}$.

In the method for driving the mini-LED backlight module provided in the present application, in the dividing the adjusting sub-field corresponding to each partition into the bright sub-field and the dark sub-field in Step S300, the duration of the bright sub-field corresponding to the first partition is zero, and the duration of the bright sub-field corresponding to the M-th partition is equal to the duration of the adjusting sub-field.

In the method for driving the mini-LED backlight module provided in the present application, for any two of the partitions, the duration of the bright sub-field corresponding to one partition close to the control unit is less than the duration of the bright sub-field corresponding to the other one partition away from the control unit.

In the method for driving the mini-LED backlight module provided in the present application, in Step S300, the adjusting in each of the gray modes the time duration of the bright sub-field or the dark sub-field corresponding to each partition based on the brightness value of each partition, to obtain under the gray mode the duration of the bright sub-field and the duration of the dark sub-field that make the brightness difference between each partition and the first partition fall within a second brightness threshold range, includes:

driving the mini-LED backlight module to emit light in a L-th gray mode, wherein a gray level corresponding to the L-th gray mode is L, where $0 \le L \le 2^N-1$, and a number of the gray modes of the mini-LED backlight module is $2^N$; and adjusting under the L-th gray mode the time duration of the bright sub-field or the dark sub-field corresponding to each partition based on the brightness value of each partition, to obtain under the L-th gray mode the duration of the bright sub-field and the duration of the dark sub-field that make the brightness difference between each partition and the first partition fall within the second brightness threshold range.

In the method for driving the mini-LED backlight module provided in the present application, in Step S300, the driving the mini-LED backlight module to emit light in different gray modes, includes:

configuring an initial value of the gray level L as 1 and a step-size to adjust the gray level as S, wherein in driving the mini-LED backlight module to emit light for two times adjacently under different gray modes, the step-size S to adjust the gray level is defined by subtracting the gray level of the gray mode used first time from the gray level of the gray mode used second time.

In the method for driving the mini-LED backlight module provided in the present application, the adjusting in the L-th gray mode the time duration of the bright sub-field or the dark sub-field corresponding to each partition based on the brightness value of each partition, to obtain under the gray mode the duration of the bright sub-field and the duration of the dark sub-field that make the brightness difference between each partition and the first partition fall within a second brightness threshold range, includes:

under the L-th gray mode, increasing the time duration of the bright sub-field corresponding to the m-th partition or decreasing the time duration of the dark sub-field corresponding to the m-th partition when the brightness difference between the first partition and the m-th partition exceeds the second brightness threshold range and the brightness value of the first partition is greater than the brightness value of the m-th partition; or decreasing the time duration of the bright sub-field corresponding to the m-th partition or increasing the time duration of the dark sub-field corresponding to the m-th partition when the brightness difference between the first partition and the m-th partition exceeds the second brightness threshold range and the brightness value of the first partition is less than the brightness value of the m-th partition; driving the mini-LED backlight module to emit light in the L-th gray mode based on the adjusted duration of the bright sub-field corresponding to the m-th partition and the adjusted duration of the dark sub-field corresponding to the m-th partition; or under the L-th gray mode, obtaining the duration $T_{bright\,(m,L)}$ of the bright sub-field and the duration $T_{dark\,(m,L)}$ of the dark sub-field corresponding to the m-th partition once the driving of the mini-LED backlight module makes the brightness difference between the first partition and the m-th partition fall within the second brightness threshold range, where m is a partition number, and $2 \le m \le M$.

In the method for driving the mini-LED backlight module provided in the present application, in a same gray mode, an initial value of the partition number is configured as 2, wherein in adjusting the bright sub-field or the dark sub-field corresponding to different partitions for two times adjacently, the partition number of the partition adjusted second time is 1 greater than the partition number of the partition adjusted first time.

Beneficial Effects

The beneficial effects of the present application are described as follows. In the present application, by dividing the mini-LED backlight module into a plurality of partitions along an extending direction of a data line, dividing a period of each frame used in the mini-LED backlight module into an adjusting sub-field, and adjusting durations of a bright sub-field or a dark sub-field of the adjusting sub-field corresponding to different partitions based on different gray modes, the brightness of each partition falls within a configured brightness threshold range, thereby realizing brightness uniformity of the mini-LED backlight module.

DESCRIPTION OF DRAWINGS

For explaining the technical solutions used in the existing arts or the embodiments more clearly, the appended figures to be used in describing the existing arts or the embodiments will be briefly introduced in the following. Obviously, the appended figures described below are only some of the embodiments of the invention, and those of ordinary skill in the art can further obtain other figures according to these figures without making any inventive effort.

DESCRIPTION OF EMBODIMENTS OF THE DISCLOSURE

Figure 1:
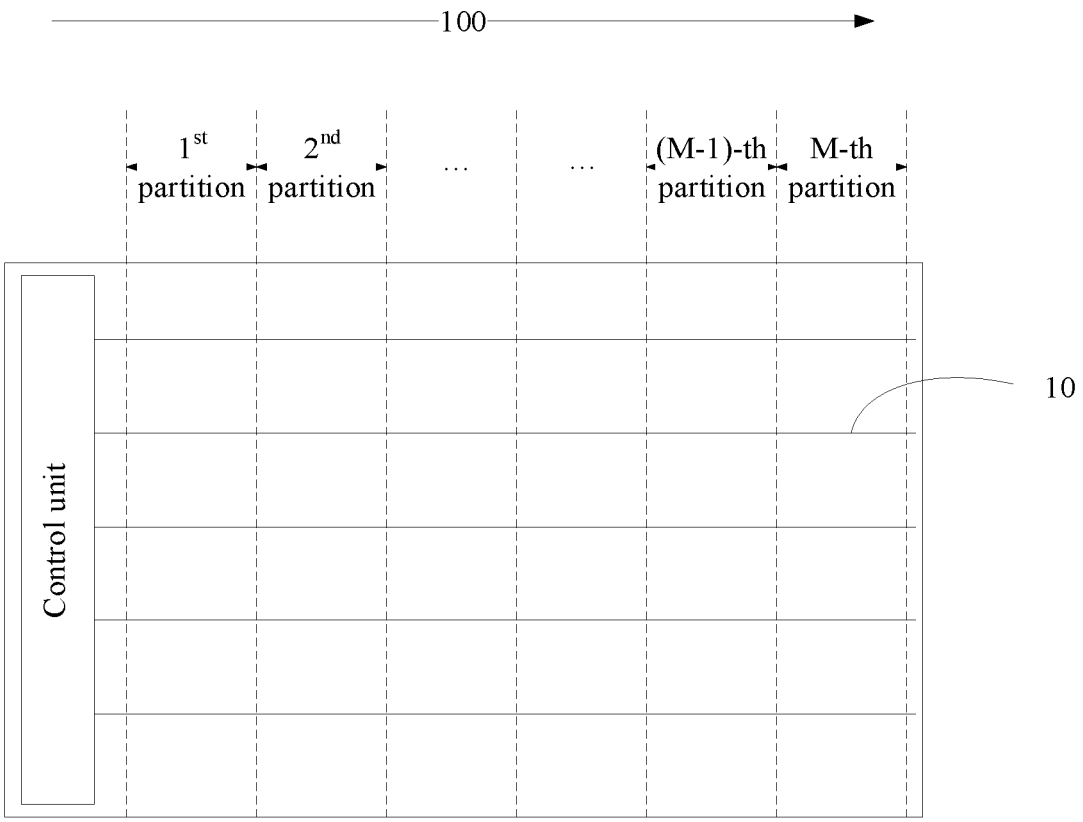
FIG. 1 is a structural schematic diagram illustrating division of a mini-LED backlight module in an embodiment of the present application.

The following descriptions for the respective embodiments are specific embodiments capable of being implemented for illustrations of the present invention with referring to the appended figures. In describing the present invention, spatially relative terms such as "upper", "lower", "front", "back", "left", "right", "inner", "outer", "lateral", and the like, may be used herein for ease of description as illustrated in the figures. Therefore, the spatially relative terms used herein are intended to illustrate the present invention for ease of understanding, but are not intended to limit the present invention. In the appended figures, units with similar structures are indicated by same reference numbers.

In the description of the present application, it is to be understood that the terms "center", "longitudinal", "lateral", "length", "width", "thickness", "upper", "lower", "front", "rear", "left", "right", "vertical", "horizontal", "top", "bottom", "inner", "outer", "clockwise", "counterclockwise" and the like indicated orientation or positional relationship are based on the relationship of the position or orientation shown in the drawings, which is only for the purpose of facilitating description of the present application and simplifying the description, but is not intended to or implied that the device or element referred to must have a specific orientation, and be constructed and operated in a particular orientation. Therefore, it should not be construed as a limitation of the present application. In addition, the terms "first" and "second" are used for descriptive purposes only, and should not be taken to indicate or imply relative importance, or implicitly indicate the indicated number of technical features. Thus, by defining a feature with "first" or "second", it may explicitly or implicitly include one or more features. In the description of the present application, "a plurality" means two or more unless explicitly defined.

In the description of the present application, it should be noted that unless otherwise explicitly specified or limited, the terms "installed", "connected", and "connection" should be construed broadly, for example, a fixed connection, a removable connection, or integrally connected. These terms may be directed to a mechanical connection, and may also be directed to an electrical connection or communication. Moreover, these terms can be directed to "directly attached", "indirectly connected" through an intermediate medium, and may be directed to "internally communicated" with two components or the "interaction relationship" between two components. For persons skilled in the art, they can understand the specific meaning of the terms in the present application based on specific conditions.

In the present application, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

The following disclosure provides a plurality of different embodiments or examples to implement different structures of this application. To simplify the disclosure of this application, the following describes components and settings in particular examples. Certainly, the examples are merely for illustrative purposes, and are not intended to limit this application. In addition, in this application, reference numerals and/or reference letters may be repeated in different examples. This repetition is for the purpose of simplicity and clarity, and does not in itself indicate a relationship between the various embodiments and/or settings that are discussed. In addition, this application provides examples of various particular processes and materials, but a person of ordinary skill in the art will recognize that other processes and/or materials may be applied and/or used.

The technical solutions of the present application will be described with reference to embodiments as follows.

Figure 2:
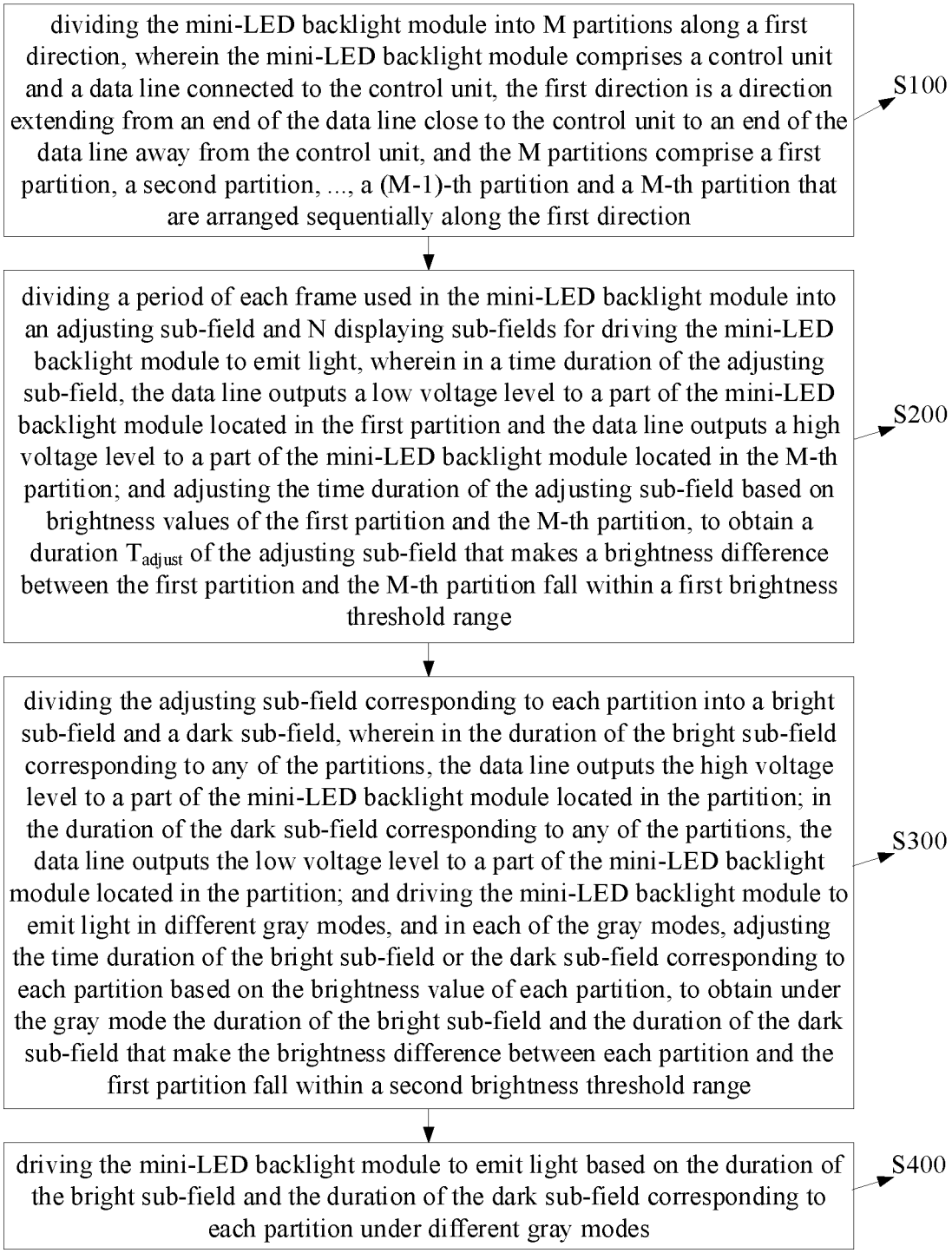
FIG. 2 is a flowchart of a method for driving a mini-LED backlight module in an embodiment of the present application.
Figure 3:
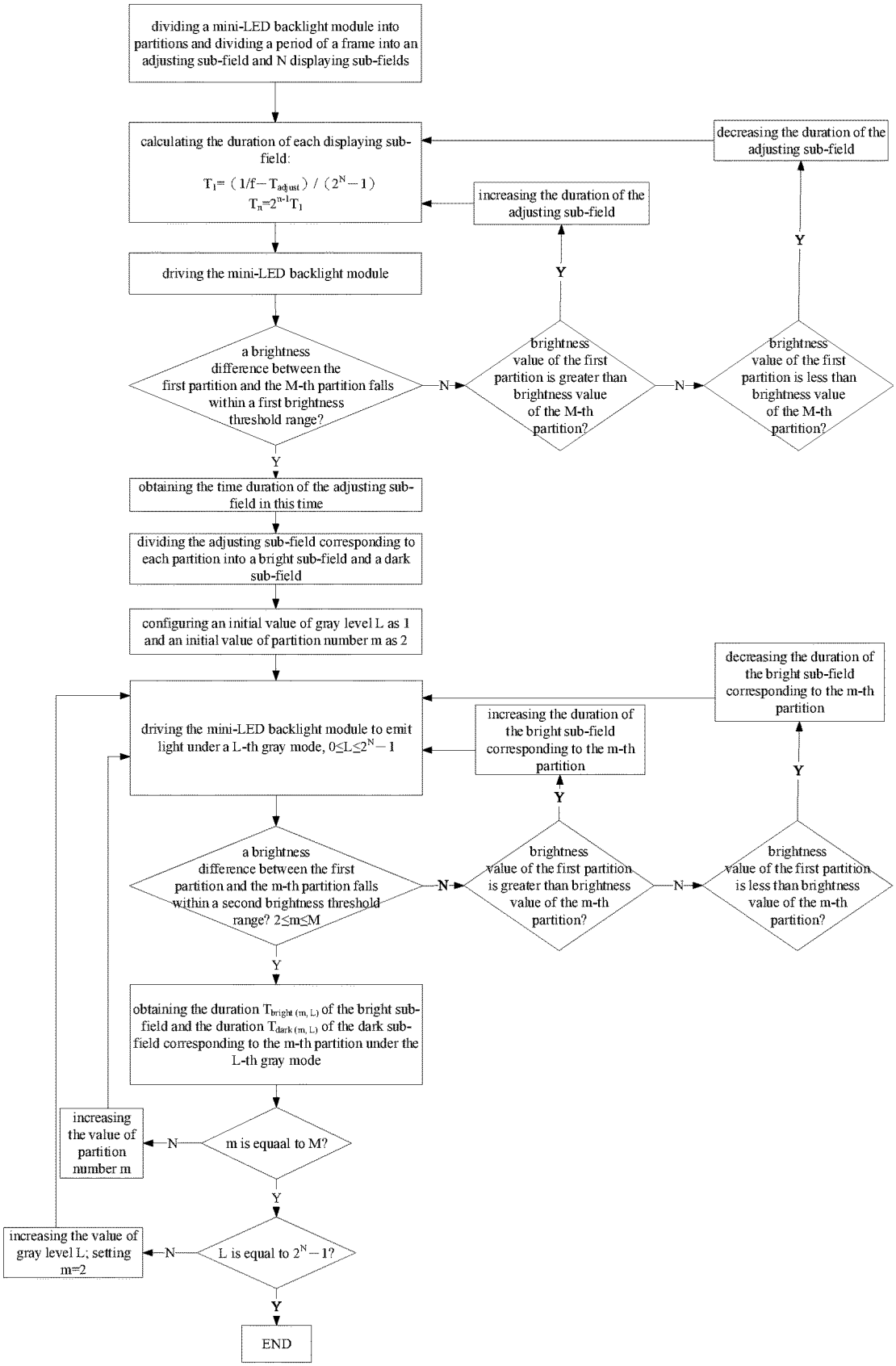
FIG. 3 is a schematic block diagram illustrating logics for a method for driving a mini-LED backlight module in an embodiment of the present application.

The present application provides a method for driving a mini light emitting diode (mini-LED) backlight module. As shown in FIGS. 1 to 3, the method includes the following steps.

Step S100: dividing the mini-LED backlight module into M partitions along a first direction 100, wherein the mini-LED backlight module includes a control unit and a data line 10 connected to the control unit, the first direction 100 is a direction extending from an end of the data line 10 close to the control unit to an end of the data line 10 away from the control unit, and the M partitions include a first partition, a second partition, . . . , a (M−1)-th partition and a M-th partition that are arranged sequentially along the first direction 100.

It can be understood that the first direction 100 is a direction away from the control unit. Specifically, the further mini-LEDs of the mini-LED backlight module are away from the control unit, the longer the length of the data line 10 requires and the greater the caused RC loading is. This causes a brightness difference between mini-LEDs of the mini-LED backlight module at proximal and distal ends of the data line 10. In the present embodiment, the mini-LED backlight module is divided into M partitions along the first direction. The M partitions include a first partition, a second partition, . . . , a (M−1)-th partition and a M-th partition that are arranged sequentially along the first direction 100. Obviously, the first partition is located closest to the control unit, that is, the data line 10 connected between the mini-LED of the first partition and the control unit is the shortest one. Conversely, the M-th partition is located farthest from the control unit, that is, the data line 10 connected between the mini-LED of the M-th partition and the control unit is the longest one. Accordingly, dividing the mini-LED backlight module into M partitions along the first direction 100 is beneficial for ease of controlling each partition.

Step S200: dividing a period of each frame used in the mini-LED backlight module into an adjusting sub-field and N displaying sub-fields for driving the mini-LED backlight module to emit light, wherein in a time duration of the adjusting sub-field, the data line 10 outputs a low voltage level to a part of the mini-LED backlight module located in the first partition and the data line 10 outputs a high voltage level to a part of the mini-LED backlight module located in the M-th partition; and adjusting the time duration of the adjusting sub-field based on brightness values of the first partition and the M-th partition, to obtain a duration $T_{adjust}$ of the adjusting sub-field that makes a brightness difference between the first partition and the M-th partition fall within a first brightness threshold range;

Step S300: dividing the adjusting sub-field corresponding to each partition into a bright sub-field and a dark sub-field, wherein in the duration of the bright sub-field corresponding to any of the partitions, the data line 10 outputs the high voltage level to a part of the mini-LED backlight module located in the partition; in the duration of the dark sub-field corresponding to any of the partitions, the data line 10 outputs the low voltage level to a part of the mini-LED backlight module located in the partition; and driving the mini-LED backlight module to emit light in different gray modes, and in each of the gray modes, adjusting the time duration of the bright sub-field or the dark sub-field corresponding to each partition based on the brightness value of each partition, to obtain under the gray mode the duration of the bright sub-field and the duration of the dark sub-field that make the brightness difference between each partition and the first partition fall within a second brightness threshold range; and Step S400: driving the mini-LED backlight module to emit light based on the duration of the bright sub-field and the duration of the dark sub-field corresponding to each partition under different gray modes.

It can be understood that currently, mini-LED backlight driving methods based on active matrix (AM) type have become an efficient solution to reduce the number of LED driving chips to realize cost reduction; however, with the development of surface mounted technology (SMT) and the needs to reduce the cost of mini-LED backlight, a single backlight plate is getting bigger and bigger, resulting in inconsistent RC loading for proximal and distal ends of the data line 10. Specifically, RC loading at the proximal end of the data line 10 is relatively small, and RC loading at the distal end of the data line 10 is relatively large. In addition, an IR drop effect exists. All these factors cause the brightness difference between mini-LEDs of the mini-LED backlight plate at the proximal and distal ends of the data line 10. In the mini-LED backlight plate, the part close to the proximal end of the data line 10 is relatively bright, and the part close to the distal end of the data line 10 is relatively dark. Accordingly, it causes uneven brightness of the mini-LED backlight plate and seriously affects backlight quality.

In the present embodiment, by dividing the mini-LED backlight module into a plurality of partitions along an extending direction of a data line 10, dividing a period of each frame used in the mini-LED backlight module into an adjusting sub-field, and adjusting durations of a bright sub-field or a dark sub-field of the adjusting sub-field corresponding to different partitions based on different gray modes, the brightness of each partition falls within a configured brightness threshold range, thereby realizing brightness uniformity of the mini-LED backlight module.

It is worth to be noted that in Step S200, the period of each frame of the mini-LED backlight module is divided into an adjusting sub-field and N displaying sub-fields, and the adjusting sub-field is used to adjust the brightness of each frame displayed by the mini-LED backlight module. In Step S300, the adjusting sub-field is divided into a bright sub-field and a dark sub-field. Specifically, during the mini-LED backlight module operates, the data line 10 outputs a high voltage level in the time duration of the bright sub-field and outputs a low voltage level in the time duration of the dark sub-field. Accordingly, by adjusting the time duration of the bright sub-field or the dark sub-field of the adjusting sub-field corresponding to different partitions under different gray modes, the brightness uniformity of the mini-LED backlight module can be realized. In addition, in the present application, a mini-LED backlight module of a 1G1D architecture with a frequency of 240 Hz and N=6 bits is taken for example, unless otherwise specified. In the present embodiment, the mini-LED backlight module is divided into four partitions along the first direction, that is, M=4, and the period of each frame of the mini-LED backlight module is divided into one adjusting sub-field and six displaying sub-fields. In driving the mini-LED backlight module to emit light under different gray modes, the number of gray modes is $2^6$, for example.

In an embodiment, as shown in FIGS. 2 and 3, in Step 200, the adjusting the time duration of the adjusting sub-field based on brightness values of the first partition and the M-th partition, to obtain a duration $T_{adjust}$ of the adjusting sub-field that makes a brightness difference between the first partition and the M-th partition fall within a first brightness threshold range, includes:

increasing the time duration of the adjusting sub-field when the brightness difference between the first partition and the M-th partition exceeds the first brightness threshold range and the brightness value of the first partition is greater than the brightness value of the M-th partition; or decreasing the time duration of the adjusting sub-field when the brightness difference between the first partition and the M-th partition exceeds the first brightness threshold range and the brightness value of the first partition is less than the brightness value of the M-th partition; driving the mini-LED backlight module to emit light, wherein in the increased or decreased time duration of the adjusting sub-field, the data line 10 outputs the low voltage level to a part of the mini-LED backlight module located in the first partition and the data line 10 outputs the high voltage level to a part of the mini-LED backlight module located in the M-th partition; or obtaining the duration $T_{adjust}$ of the adjusting sub-field once the driving of the mini-LED backlight module makes the brightness difference between the first partition and the M-th partition fall within the first brightness threshold range.

It can be understood that in the present embodiment, M=4, and the brightness value of the first partition and the brightness value of the M-th partition are the brightness value of the first partition and the brightness value of the fourth partition, respectively. Specifically, in order to adjust the duration of the adjusting sub-field, in driving the mini-LED backlight module to emit light, by making the data line 10 output the low voltage level to the part of the mini-LED backlight module located in the first partition and making the data line 10 output the high voltage level to the part of the mini-LED backlight module located in the M-th partition within the time duration of the adjusting sub-field, the difference between the first partition and the M-th partition can be minimized. Then, adjusting the time duration of the adjusting sub-field can further make the brightness difference between the first partition and the M-th partition be easy to fall within the first brightness threshold range. In such a way, it is easy and quick to obtain the time duration $T_{adjust}$ of the adjusting sub-field that makes the brightness difference between the first partition and the M-th partition fall within the first brightness threshold range.

It is worth to be noted that after the time duration of the adjusting sub-field is adjusted, the mini-LED backlight module is re-driven to emit light using the adjusted time duration of the adjusting sub-field, wherein in the increased or decreased time duration of the adjusting sub-field, the data line 10 outputs the low voltage level to a part of the mini-LED backlight module located in the first partition and the data line 10 outputs the high voltage level to a part of the mini-LED backlight module located in the M-th partition, until the brightness difference between the first partition and the M-th partition falls within the first brightness threshold range.

In an embodiment, in Step S200, before each time the mini-LED backlight module is driven to emit light, the method includes calculating the duration of each displaying sub-field based on the following formulas:

$$T_1=(1/f-T_{adjust})/(2^N-1); \text{ and}$$

$$T_n=2^{n-1}T_1,$$

where $T_1$ is the duration of a first displaying sub-field, $T_n$ is the duration of an n-th displaying sub-field, $2 \le n \le N$, and f is a display frequency of the mini-LED backlight module.

It can be understood that in the present embodiment, f=240 Hz, N=6, and a relation between the displaying sub-fields is $T_6=2T_5=4T_4=8T_3=16T_2=32T_1$. In Step S200, for each time the mini-LED backlight module is driven to emit light, it needs to take consideration of the duration of each displaying sub-field.

In an embodiment, when the brightness difference between the first partition and the M-th partition exceeds the first brightness threshold range and the brightness value of the first partition is greater than the brightness value of the M-th partition, the time duration of the adjusting sub-field increases and an amount of time increased for each time is $T_{increase}$, when the brightness difference between the first partition and the M-th partition exceeds the first brightness threshold range and the brightness value of the first partition is less than the brightness value of the M-th partition, the time duration of the adjusting sub-field decreases and an amount of time decreased for each time is $T_{decrease}$, wherein $T_{increase}=T_{decrease}$.

It can be understood that in adjusting the time duration of the adjusting sub-field, $T_{increase}$ may be equal to or different from $T_{decrease}$. In the present embodiment, $T_{increase}$ and $T_{decrease}$ are set to be equal to each other for ease of unify the precision of adjustment of the adjusting sub-field. It can be avoided that the difference between $T_{increase}$ and $T_{decrease}$ is too large. Specifically, $T_{increase}$ and $T_{decrease}$ may be configured depending on practical situations.

In an embodiment, in Step S300, in the dividing the adjusting sub-field corresponding to each partition into the bright sub-field and the dark sub-field, the duration of the bright sub-field corresponding to the first partition is zero, and the duration of the bright sub-field corresponding to the M-th partition is equal to the duration of the adjusting sub-field.

It can be understood that the duration of the adjusting sub-field corresponding to any of the partitions is a sum of the duration of the bright sub-field and the duration of the dark sub-field. the duration of the bright sub-field corresponding to the first partition is configured as zero, that is, this means the adjusting sub-field corresponding to the first partition is all taken as the dark sub-field. The duration of the bright sub-field corresponding to the M-th partition is equal to the duration of the adjusting sub-field, that is, this means the duration of the dark sub-field corresponding to the M-th partition is zero, and the adjusting sub-field corresponding to the M-th partition is all taken as the bright sub-field.

In an embodiment, for any two of the partitions, the duration of the bright sub-field corresponding to one partition close to the control unit is less than the duration of the bright sub-field corresponding to the other one partition away from the control unit. It can be understood that the closer to the control unit, the shorter the data line 10 connected between the control unit and the mini-LED of the partition and the smaller the corresponding affection of RC loading. Accordingly, no matter when the adjusting sub-field is divided into the bright sub-field and the dark sub-field initially or when the duration of the bright sub-field corresponding to each partition is calculated finally, for the partition connected to the data line 10 in a relatively short length, the corresponding allocated duration of the bright sub-field should be relatively short.

In an embodiment, as shown in FIG. 3, in Step S300, the adjusting in each of the gray modes the time duration of the bright sub-field or the dark sub-field corresponding to each partition based on the brightness value of each partition, to obtain under the gray mode the duration of the bright sub-field and the duration of the dark sub-field that make the brightness difference between each partition and the first partition fall within a second brightness threshold range, includes:

driving the mini-LED backlight module to emit light in a L-th gray mode, wherein a gray level corresponding to the L-th gray mode is L, where $0 \le L \le 2^N-1$, and a number of the gray modes of the mini-LED backlight module is $2^N$; and adjusting under the L-th gray mode the time duration of the bright sub-field or the dark sub-field corresponding to each partition based on the brightness value of each partition, to obtain under the L-th gray mode the duration of the bright sub-field and the duration of the dark sub-field that make the brightness difference between each partition and the first partition fall within the second brightness threshold range.

It can be understood that in the present embodiment, the number of the gray modes of the mini-LED backlight module is $2^6$, and the gray level corresponding to the L-th gray mode is L, where $0 \le L \le 2^N-1$. Specifically, the gray levels L includes 0, 1 . . . $2^6-2$, $2^6-1$. Obviously, it needs to obtain the duration of the bright sub-field and the duration of the dark sub-field that make the brightness difference between each partition and the first partition fall within the second brightness threshold range under each of the gray modes, wherein when the gray level L is equal to zero, the mini-LED backlight module is in a totally dark mode, and there is thus no need to calculate the duration of the bright sub-field and the duration of the dark sub-field corresponding to each partition.

In an embodiment, as shown in FIG. 3, in Step S300, the driving the mini-LED backlight module to emit light in different gray modes, includes:

configuring an initial value of the gray level L as 1 and a step-size to adjust the gray level as S, wherein in driving the mini-LED backlight module to emit light for two times adjacently under different gray modes, the step-size S to adjust the gray level is defined by subtracting the gray level of the gray mode used first time from the gray level of the gray mode used second time.

It can be understood that the initial value of the gray level L is configured as 1, and every when the duration of the bright sub-field and the duration of the dark sub-field corresponding to each partition are obtained in one gray mode, enter a next gray mode, wherein in driving the mini-LED backlight module to emit light for two times adjacently under different gray modes, the step-size S to adjust the gray level is defined by subtracting the gray level of the gray mode used first time from the gray level of the gray mode used second time. It is worth to be noted that the method further includes a gray level determining step. When the gray level L of the gray mode currently used is a maximum, that is, the gray level $L=2^6-1$ in the present embodiment, execute Step S400.

In an embodiment, the adjusting under the L-th gray mode the time duration of the bright sub-field or the dark sub-field corresponding to each partition based on the brightness value of each partition, to obtain under the L-th gray mode the duration of the bright sub-field and the duration of the dark sub-field that make the brightness difference between each partition and the first partition fall within the second brightness threshold range, includes:

under the L-th gray mode, increasing the time duration of the bright sub-field corresponding to the m-th partition or decreasing the time duration of the dark sub-field corresponding to the m-th partition when the brightness difference between the first partition and the m-th partition exceeds the second brightness threshold range and the brightness value of the first partition is greater than the brightness value of the m-th partition; or decreasing the time duration of the bright sub-field corresponding to the m-th partition or increasing the time duration of the dark sub-field corresponding to the m-th partition when the brightness difference between the first partition and the m-th partition exceeds the second brightness threshold range and the brightness value of the first partition is less than the brightness value of the m-th partition; driving the mini-LED backlight module to emit light in the L-th gray mode based on the adjusted duration of the bright sub-field corresponding to the m-th partition and the adjusted duration of the dark sub-field corresponding to the m-th partition; or under the L-th gray mode, obtaining the duration $T_{bright\ (m,\ L)}$ of the bright sub-field and the duration $T_{dark\ (m,\ L)}$ of the dark sub-field corresponding to the m-th partition once the driving of the mini-LED backlight module makes the brightness difference between the first partition and the m-th partition fall within the second brightness threshold range, where m is a partition number, and $2 \leq m \leq M$.

It can be understood that after each time the duration of the bright sub-field corresponding to the m-th partition or the duration of the dark sub-field corresponding to the m-th partition is adjusted, in re-driving the mini-LED backlight module, it needs to drive the mini-LED backlight module to emit light under the L-th gray mode based on the adjusted duration of the bright sub-field corresponding to the m-th partition and the adjusted duration of the dark sub-field corresponding to the m-th partition. Also, in the present embodiment, in a same gray mode, an initial value of the partition number m is configured as 2, wherein in adjusting the bright sub-field or the dark sub-field corresponding to different partitions for two times adjacently, the partition number of the partition adjusted second time is 1 greater than the partition number of the partition adjusted first time.

It can be understood that the initial number of the partition number m is configured as 2, and after each time the duration of the bright sub-field and the duration of the dark sub-field corresponding to the m-th partition are obtained under the L-th gray mode, obtaining the duration of the bright sub-field and the duration of the dark sub-field corresponding to a next partition is executed. Specifically, in adjusting the bright sub-field or the dark sub-field corresponding to different partitions for two times adjacently, the partition number of the partition adjusted second time is 1 greater than the partition number of the partition adjusted first time. It is worth to be noted that the method further includes a partition determining step. When the partition number m of the m-th partition currently used is a maximum, that is, the partition number m=M=4 in the present embodiment, obtaining the duration of the bright sub-field and the duration of the dark sub-field that make the brightness difference between each partition and the first partition fall within the second brightness threshold range is finished for the current gray mode.

Above all, in the present application, by dividing the mini-LED backlight module into a plurality of partitions along an extending direction of a data line 10, dividing a period of each frame used in the mini-LED backlight module into an adjusting sub-field, and adjusting durations of a bright sub-field or a dark sub-field of the adjusting sub-field corresponding to different partitions based on different gray modes, the brightness of each partition falls within a configured brightness threshold range, thereby realizing brightness uniformity of the mini-LED backlight module.

While the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and realm of the present invention are within the scope as defined in the appended claims.

The invention claimed is:

1. A method for driving a mini light emitting diode (mini-LED) backlight module, comprising steps of:

Step S100: dividing the mini-LED backlight module into M partitions along a first direction, wherein the mini-LED backlight module comprises a control unit and a data line connected to the control unit, the first direction is a direction extending from an end of the data line close to the control unit to an end of the data line away from the control unit, and the M partitions comprise a first partition, a second partition, . . . , a (M−1)-th partition and a M-th partition that are arranged sequentially along the first direction;

Step S200: dividing a period of each frame used in the mini-LED backlight module into an adjusting sub-field and N displaying sub-fields for driving the mini-LED backlight module to emit light, wherein in a time duration of the adjusting sub-field, the data line outputs a low voltage level to a part of the mini-LED backlight module located in the first partition and the data line outputs a high voltage level to a part of the mini-LED backlight module located in the M-th partition; and adjusting the time duration of the adjusting sub-field based on brightness values of the first partition and the M-th partition, to obtain a duration $T_{adjust}$ of the adjusting sub-field that makes a brightness difference between the first partition and the M-th partition fall within a first brightness threshold range;

Step S300: dividing the adjusting sub-field corresponding to each partition into a bright sub-field and a dark sub-field, wherein in a duration of the bright sub-field corresponding to any of the partitions, the data line outputs the high voltage level to a part of the mini-LED backlight module located in the any of partitions; in a duration of the dark sub-field corresponding to any of the partitions, the data line outputs the low voltage level to a part of the mini-LED backlight module located in the any of partitions; and driving the mini-LED backlight module to emit light in different gray modes, and in each of the gray modes, adjusting a time duration of the bright sub-field or the dark sub-field corresponding to each partition based on the brightness value of each partition, to obtain under the gray mode a duration of the bright sub-field and a duration of the dark sub-field that make the brightness difference between each partition and the first partition fall within a second brightness threshold range; and Step S400: driving the mini-LED backlight module to emit light based on a duration of the bright sub-field and a duration of the dark sub-field corresponding to each partition under different gray modes.

2. The method for driving the mini-LED backlight module according to claim 1, wherein in Step 200, the adjusting the time duration of the adjusting sub-field based on brightness values of the first partition and the M-th partition, to obtain a duration $T_{adjust}$ of the adjusting sub-field that makes a brightness difference between the first partition and the M-th partition fall within a first brightness threshold range, comprises:

increasing the time duration of the adjusting sub-field when the brightness difference between the first partition and the M-th partition exceeds the first brightness threshold range and the brightness value of the first partition is greater than the brightness value of the M-th partition; or decreasing the time duration of the adjusting sub-field when the brightness difference between the first partition and the M-th partition exceeds the first brightness threshold range and the brightness value of the first partition is less than the brightness value of the M-th partition; driving the mini-LED backlight module to emit light, wherein in the increased or decreased time duration of the adjusting sub-field, the data line outputs the low voltage level to a part of the mini-LED backlight module located in the first partition and the data line outputs the high voltage level to a part of the mini-LED backlight module located in the M-th partition; or obtaining the duration $T_{adjust}$ of the adjusting sub-field once the driving of the mini-LED backlight module makes the brightness difference between the first partition and the M-th partition fall within the first brightness threshold range.

3. The method for driving the mini-LED backlight module according to claim 2, wherein in Step S200, before each time the mini-LED backlight module is driven to emit light, the method comprises calculating a duration of each displaying sub-field based on the following formulas:

$$T_1=(1/f-T_{adjust})/(2^N-1); \text{ and}$$

$$T_n=2^{n-1}T_1,$$

where $T_1$ is a duration of a first displaying sub-field, $T_n$ is a duration of an n-th displaying sub-field, $2 \le n \le N$, and f is a display frequency of the mini-LED backlight module.

4. The method for driving the mini-LED backlight module according to claim 2, wherein when the brightness difference between the first partition and the M-th partition exceeds the first brightness threshold range and the brightness value of the first partition is greater than the brightness value of the M-th partition, the time duration of the adjusting sub-field increases and an amount of time increased for each time is $T_{increase}$; and when the brightness difference between the first partition and the M-th partition exceeds the first brightness threshold range and the brightness value of the first partition is less than the brightness value of the M-th partition, the time duration of the adjusting sub-field decreases and an amount of time decreased for each time is $T_{decrease}$, wherein $T_{increase}=T_{decrease}$.

5. The method for driving the mini-LED backlight module according to claim 1, wherein in the dividing the adjusting sub-field corresponding to each partition into the bright sub-field and the dark sub-field in Step S300, a duration of the bright sub-field corresponding to the first partition is zero, and a duration of the bright sub-field corresponding to the M-th partition is equal to the duration of the adjusting sub-field.

6. The method for driving the mini-LED backlight module according to claim 5, wherein for any two of the partitions, a duration of the bright sub-field corresponding to one partition close to the control unit is less than a duration of the bright sub-field corresponding to the other one partition away from the control unit.

7. The method for driving the mini-LED backlight module according to claim 5, wherein in Step S300, the adjusting in each of the gray modes a time duration of the bright sub-field or the dark sub-field corresponding to each partition based on the brightness value of each partition, to obtain under the gray mode a duration of the bright sub-field and a duration of the dark sub-field that make the brightness difference between each partition and the first partition fall within a second brightness threshold range, comprises:

driving the mini-LED backlight module to emit light in a L-th gray mode, wherein a gray level corresponding to the L-th gray mode is L, where $0 \le L \le 2^{N-1}$, and a number of the gray modes of the mini-LED backlight module is $2^N$; and adjusting under the L-th gray mode a time duration of the bright sub-field or the dark sub-field corresponding to each partition based on the brightness value of each partition, to obtain under the L-th gray mode a duration of the bright sub-field and a duration of the dark sub-field that make the brightness difference between each partition and the first partition fall within the second brightness threshold range.

8. The method for driving the mini-LED backlight module according to claim 7, wherein in Step S300, the driving the mini-LED backlight module to emit light in different gray modes, comprises:

configuring an initial value of the gray level L as 1 and a step-size to adjust the gray level as S, wherein in driving the mini-LED backlight module to emit light for two times adjacently under different gray modes, the step-size S to adjust the gray level is defined by subtracting the gray level of the gray mode used first time from the gray level of the gray mode used second time.

9. The method for driving the mini-LED backlight module according to claim 7, wherein the adjusting in the L-th gray mode a time duration of the bright sub-field or the dark sub-field corresponding to each partition based on the brightness value of each partition, to obtain under the gray mode a duration of the bright sub-field and a duration of the dark sub-field that make the brightness difference between each partition and the first partition fall within a second brightness threshold range, comprises:

under the L-th gray mode, increasing a time duration of the bright sub-field corresponding to the m-th partition or decreasing a time duration of the dark sub-field corresponding to the m-th partition when the brightness difference between the first partition and the m-th partition exceeds the second brightness threshold range and the brightness value of the first partition is greater than the brightness value of the m-th partition; or decreasing a time duration of the bright sub-field corresponding to the m-th partition or increasing a time duration of the dark sub-field corresponding to the m-th partition when the brightness difference between the first partition and the m-th partition exceeds the second brightness threshold range and the brightness value of the first partition is less than the brightness value of the m-th partition; driving the mini-LED backlight module to emit light in the L-th gray mode based on the adjusted duration of the bright sub-field corresponding to the m-th partition and the adjusted duration of the dark sub-field corresponding to the m-th partition; or under the L-th gray mode, obtaining the duration $T_{bright\ (m,\ L)}$ of the bright sub-field and the duration $T_{dark\ (m,\ L)}$ of the dark sub-field corresponding to the m-th partition once the driving of the mini-LED backlight module makes the brightness difference between the first partition and the m-th partition fall within the second brightness threshold range, where m is a partition number, $2 \leq m \leq M$.

10. The method for driving the mini-LED backlight module according to claim 9, wherein in a same gray mode, an initial value of the partition number is configured as 2, wherein in adjusting the bright sub-field or the dark sub-field corresponding to different partitions for two times adjacently, the partition number of the partition adjusted second time is 1 greater than the partition number of the partition adjusted first time.

11. A method for driving a mini light emitting diode (mini-LED) backlight module, comprising steps of:

Step S100: dividing the mini-LED backlight module into M partitions along a first direction, wherein the mini-LED backlight module comprises a control unit and a data line connected to the control unit, the first direction is a direction extending from an end of the data line close to the control unit to an end of the data line away from the control unit, and the M partitions comprise a first partition, a second partition, . . . , a (M−1)-th partition and a M-th partition that are arranged sequentially along the first direction;

Step S200: dividing a period of each frame used in the mini-LED backlight module into an adjusting sub-field and N displaying sub-fields for driving the mini-LED backlight module to emit light, wherein in a time duration of the adjusting sub-field, the data line outputs a low voltage level to a part of the mini-LED backlight module located in the first partition and the data line outputs a high voltage level to a part of the mini-LED backlight module located in the M-th partition; and adjusting the time duration of the adjusting sub-field based on brightness values of the first partition and the M-th partition, to obtain a duration $T_{adjust}$ of the adjusting sub-field that makes a brightness difference between the first partition and the M-th partition fall within a first brightness threshold range;

wherein the adjusting the time duration of the adjusting sub-field based on brightness values of the first partition and the M-th partition, to obtain a duration $T_{adjust}$ of the adjusting sub-field that makes a brightness difference between the first partition and the M-th partition fall within a first brightness threshold range, comprises:

increasing the time duration of the adjusting sub-field when the brightness difference between the first partition and the M-th partition exceeds the first brightness threshold range and the brightness value of the first partition is greater than the brightness value of the M-th partition; or decreasing the time duration of the adjusting sub-field when the brightness difference between the first partition and the M-th partition exceeds the first brightness threshold range and the brightness value of the first partition is less than the brightness value of the M-th partition; driving the mini-LED backlight module to emit light, wherein in the increased or decreased time duration of the adjusting sub-field, the data line outputs the low voltage level to a part of the mini-LED backlight module located in the first partition and the data line outputs the high voltage level to a part of the mini-LED backlight module located in the M-th partition; or obtaining the duration $T_{adjust}$ of the adjusting sub-field once the driving of the mini-LED backlight module makes the brightness difference between the first partition and the M-th partition fall within the first brightness threshold range;

Step S300: dividing the adjusting sub-field corresponding to each partition into a bright sub-field and a dark sub-field, wherein in a duration of the bright sub-field corresponding to any of the partitions, the data line outputs the high voltage level to a part of the mini-LED backlight module located in the any of partitions in a duration of the dark sub-field corresponding to any of the partitions, the data line outputs the low voltage level to a part of the mini-LED backlight module located in the any of partitions; and driving the mini-LED backlight module to emit light in different gray modes, and in each of the gray modes, adjusting a time duration of the bright sub-field or the dark sub-field corresponding to each partition based on the brightness value of each partition, to obtain under the gray mode a duration of the bright sub-field and a duration of the dark sub-field that make the brightness difference between each partition and the first partition fall within a second brightness threshold range;

wherein in the dividing the adjusting sub-field corresponding to each partition into the bright sub-field and the dark sub-field, a duration of the bright sub-field corresponding to the first partition is zero, and a duration of the bright sub-field corresponding to the M-th partition is equal to the duration of the adjusting sub-field; and Step S400: driving the mini-LED backlight module to emit light based on a duration of the bright sub-field and a duration of the dark sub-field corresponding to each partition under different gray modes.

12. The method for driving the mini-LED backlight module according to claim 11, wherein in Step S200, before each time the mini-LED backlight module is driven to emit light, the method comprises calculating a duration of each displaying sub-field based on the following formulas:

$$T_1=(1/f-T_{adjust})/(2^N-1); \text{ and}$$

$$T_n=2^{n-1}T_1,$$

where $T_1$ is a duration of a first displaying sub-field, $T_n$ is a duration of an n-th displaying sub-field, $2 \le n \le N$, and f is a display frequency of the mini-LED backlight module.

13. The method for driving the mini-LED backlight module according to claim 11, wherein when the brightness difference between the first partition and the M-th partition exceeds the first brightness threshold range and the brightness value of the first partition is greater than the brightness value of the M-th partition, the time duration of the adjusting sub-field increases and an amount of time increased for each time is $T_{increase}$; and when the brightness difference between the first partition and the M-th partition exceeds the first brightness threshold range and the brightness value of the first partition is less than the brightness value of the M-th partition, the time duration of the adjusting sub-field decreases and an amount of time decreased for each time is $T_{decrease}$, wherein $T_{increase}=T_{decrease}$.

14. The method for driving the mini-LED backlight module according to claim 11, wherein for any two of the partitions, a duration of the bright sub-field corresponding to one partition close to the control unit is less than a duration of the bright sub-field corresponding to the other one partition away from the control unit.

15. The method for driving the mini-LED backlight module according to claim 11, wherein in Step S300, the adjusting in each of the gray modes a time duration of the bright sub-field or the dark sub-field corresponding to each partition based on the brightness value of each partition, to obtain under the gray mode the duration of the bright sub-field and the duration of the dark sub-field that make the brightness difference between each partition and the first partition fall within a second brightness threshold range, comprises:

driving the mini-LED backlight module to emit light in a L-th gray mode, wherein a gray level corresponding to the L-th gray mode is L, where $0 \le L \le 2^N-1$, and a number of the gray modes of the mini-LED backlight module is $2^N$; and adjusting under the L-th gray mode a time duration of the bright sub-field or the dark sub-field corresponding to each partition based on the brightness value of each partition, to obtain under the L-th gray mode a duration of the bright sub-field and a duration of the dark sub-field that make the brightness difference between each partition and the first partition fall within the second brightness threshold range.

16. The method for driving the mini-LED backlight module according to claim 15, wherein in Step S300, the driving the mini-LED backlight module to emit light in different gray modes, comprises:

configuring an initial value of the gray level L as 1 and a step-size to adjust the gray level as S, wherein in driving the mini-LED backlight module to emit light for two times adjacently under different gray modes, the step-size S to adjust the gray level is defined by subtracting the gray level of the gray mode used first time from the gray level of the gray mode used second time.

17. The method for driving the mini-LED backlight module according to claim 15, wherein the adjusting in the L-th gray mode a time duration of the bright sub-field or the dark sub-field corresponding to each partition based on the brightness value of each partition, to obtain under the gray mode a duration of the bright sub-field and a duration of the dark sub-field that make the brightness difference between each partition and the first partition fall within a second brightness threshold range, comprises:

under the L-th gray mode, increasing a time duration of the bright sub-field corresponding to the m-th partition or decreasing a time duration of the dark sub-field corresponding to the m-th partition when the brightness difference between the first partition and the m-th partition exceeds the second brightness threshold range and the brightness value of the first partition is greater than the brightness value of the m-th partition; or decreasing a time duration of the bright sub-field corresponding to the m-th partition or increasing a time duration of the dark sub-field corresponding to the m-th partition when the brightness difference between the first partition and the m-th partition exceeds the second brightness threshold range and the brightness value of the first partition is less than the brightness value of the m-th partition; driving the mini-LED backlight module to emit light in the L-th gray mode based on the adjusted duration of the bright sub-field corresponding to the m-th partition and the adjusted duration of the dark sub-field corresponding to the m-th partition; or under the L-th gray mode, obtaining the duration $T_{bright\,(m,\,L)}$ of the bright sub-field and the duration $T_{dark\,(m,\,L)}$ of the dark sub-field corresponding to the m-th partition once the driving of the mini-LED backlight module makes the brightness difference between the first partition and the m-th partition fall within the second brightness threshold range, where m is a partition number, $2 \le m \le M$.

18. The method for driving the mini-LED backlight module according to claim 17, wherein in a same gray mode, an initial value of the partition number is configured as 2, wherein in adjusting the bright sub-field or the dark sub-field corresponding to different partitions for two times adjacently, the partition number of the partition adjusted second time is 1 greater than the partition number of the partition adjusted first time.

* * * * *